United States Patent [19]

Boivin et al.

[11] Patent Number: 4,976,841

[45] Date of Patent: Dec. 11, 1990

[54] BUSBAR ARRANGEMENT FOR ALUMINUM ELECTROLYTIC CELLS

[75] Inventors: Richard F. Boivin; Jean-Paul R. Huni; Robert LeBlanc, all of Quebec, Canada

[73] Assignee: Alcan International Limited, Montreal, Canada

[21] Appl. No.: 423,944

[22] Filed: Oct. 19, 1989

[51] Int. Cl.[5] ..... C25C 3/08; C25C 3/16

[52] U.S. Cl. ..... 204/243 M; 204/244

[58] Field of Search ..... 204/243 M, 244, 67, 204/245–247

[56] References Cited

U.S. PATENT DOCUMENTS

| | | | |
|---|---|---|---|
| 2,761,830 | 9/1956 | Kibby | 204/244 |
| 3,415,724 | 12/1968 | Heaton et al. | 204/67 |
| 3,617,454 | 11/1971 | Johnson | 204/243 M |
| 4,270,993 | 6/1981 | Arita | 204/243 M X |
| 4,313,811 | 2/1982 | Blanc | 204/243 M |
| 4,397,728 | 8/1983 | Pfister et al. | 204/243 M |
| 4,474,611 | 10/1984 | Blanc et al. | 204/243 M |
| 4,592,821 | 6/1986 | Keinborg et al. | 204/244 |
| 4,654,133 | 3/1987 | Casdas et al. | 204/243 M |
| 4,683,047 | 7/1987 | Boivin et al. | 204/243 M |
| 4,713,161 | 12/1987 | Chaffy et al. | 204/243 M X |

FOREIGN PATENT DOCUMENTS

| | | | |
|---|---|---|---|
| 0582332 | 11/1977 | U.S.S.R. | 204/243 M |

*Primary Examiner*—Donald R. Valentine

*Attorney, Agent, or Firm*—Cooper & Dunham

[57] ABSTRACT

Busbar arrangements for aluminum electrolytic cells. In a first aspect, the invention provides at least one generally horizontal collector busbar on each side of the cell and a number of current tapping points along each collector busbar so that current flows along the collector busbar in opposite directions on each side of the taps. This produces changes of sign in the vertical component of the magnetic field acting on the pad in the longitudinal direction and helps to prevent pad instabilities. In a second aspect, the current taps for the collector busbars are vertically disposed so as to convey current well below the level of the metal pad so that adverse magnetic effects caused by further distribution of the current are minimized. In a third aspect, when the cells are arranged in a row, current is conveyed between cells in a round-end under-cell crisscross arrangement with long horizontal runs of the busbars of adjacent cells being positioned close together with currents flowing in opposite directions to counteract adverse magnetic effects. These aspects of the invention allow electrolytic cells to be operated more efficiently and with decreased capital investment costs.

27 Claims, 4 Drawing Sheets

BUSBAR ARRANGEMENT FOR ALUMINUM ELECTROLYTIC CELLS

BACKGROUND OF THE INVENTION

I. Field of the Invention

This invention relates to an arrangement of busbars by which current is conveyed from an aluminum electrolytic cell. More particularly, at least in certain aspects, the invention relates to an arrangement of busbars for cells arranged transversely in a row whereby current is conveyed from one cell to the cell next downstream in the row.

II. Description of the Prior Art

A typical aluminum electrolytic cell is generally rectangular having longitudinal and transverse axes and comprises a pot containing a molten cryolite-based electrolyte at a temperature of 905°C. to 980°C. Dipping into this electrolyte are carbonaceous anodes suspended by anode rods from generally two anode beams extending longitudinally of the cell. The potlining includes a carbonaceous floor which constitutes part of the cathode structure of the cell. Embedded in the carbonaceous floor are steel collector bars which extend transversely of the cell and are spaced longitudinally along it. Aluminum metal is formed by electrolysis as a molten pool (pad) of metal overlying the cell floor beneath the layer of molten electrolyte, from where it is periodically tapped. Alumina is added to and dissolved in the electrolyte as electrolysis proceeds, and oxides of carbon are removed.

These cells are arranged transversely in rows with the electric current being passed from the cathode of an upstream cell to the anode of the cell next downstream.

By "arranged transversely in rows" we mean that the cells (which are usually identical) are arranged with their transverse (short) axes parallel to, and indeed normally coincident with, the axis of a row, with each cell having a downstream side (adjacent the next downstream cell in a row) and an upstream side. The collector bars embedded in the floor of a cell extend parallel to the axis of the row and terminate at bar ends, half on the downstream side of the cell and the other half on the upstream side. Busbars and anode risers positioned outside the cell are used to carry the electric current from these collector bar ends to the anode beams of the cell next downstream.

The design of these busbars and risers is subject to various criteria. One is that they should be positioned so as to minimize the magnetic field induced in the cell, particularly the vertical component thereof. The vertical component of the induced magnetic field interacts with the horizontal component of the electric currents in the molten metal pad giving rise to horizontal forces which can affect different regions of the metal pad in different ways causing metal motion, humping of the metal surface and wave formation. These disturbances make it necessary to maintain a larger anode to cathode distance than would otherwise be desirable, which in turn increases the internal resistance of the cell.

The present tendency to build larger cells and operate them at higher current densities aggravates these problems and gives rise to further problems, for example the cost and difficulty of housing and providing adequate access to long rows of large cells.

These problems are known and various busbar arrangements have been proposed to overcome them. One type of arrangement involves passing some of the electric current from the upstream collector bars through busbars extending round the ends (i.e. adjacent the short sides) of the cell; and passing the remaining current from the upstream collector bars through busbars extending underneath the cell. By such arrangements, the vertical component of the induced magnetic field can be minimized and evened out over various regions of the cell. Arrangements of this kind are described, for example, in U.S. Pat. No. 3,415,724; U.S. Pat. No. 4,313,811; U.K. Pat. No. 1,032,810; USSR Authors Certificate No. 434 135; and Canadian Pat. No. 1,061,745.

U.S. Pat. No. 4,474,611 describes a modification of such an arrangement in which asymmetry is introduced into the distribution of current beneath and around the ends of the cells. This is achieved by dividing the upstream collector bars into three groups which are asymmetric with regard to the transverse cell axis, connecting the central (or approximately central) group to busbars passing beneath the cell, and connecting the end groups to busbars passing around the respective ends of the cell (with, in one embodiment, some of the collector bars of one end group being connected to busbars passing around the "wrong" end of the cell to achieve asymmetry). The advantage of this is stated to be a compensation for the magnetic effects from neighbouring rows of cells.

While the magnetic effects induced by neighbouring rows of cells might be of concern in those installations having two or more closely spaced rows, the magnetic effects of neighbouring cells within one row are generally more important to cell operation when the rows are appropriately spaced apart.

OBJECTS OF THE INVENTION

Accordingly, it is a principal object of the present invention to minimize the harmful effects of cell magnetohydrodynamics, especially when cells are operated in long rows of transverse cells.

Another object of the present invention, at least in certain aspects, is to make it possible to position the cells more closely so that the capital cost of housing cell rows can be minimized while allowing for adequate access between the cells of a row for cell operation, maintenance and repair.

SUMMARY OF THE INVENTION

A first aspect of the present invention is based in part on the finding that, when the vertical component of the magnetic field acting on the metal pad has the same sign (plus or minus) over extended areas of the cell, particularly along the longitudinal cell axis, coherent and growing oscillations of the molten metal surface (instabilities) can arise, due to accumulation of longitudinal momentum along the cell. It is therefore an object of this aspect of the invention to cause changes of sign of the vertical component to occur in the cell, at least in the longitudinal direction.

Thus, according to a first aspect of the present invention, there is provided, in an aluminum electrolysis cell having opposed longitudinal side walls and opposed end walls, a lining for containing cell contents including a molten metal pad, cathode collector bars extending through the lining, and cathode collector bar ends extending from each of said longitudinal side walls, the improvement which comprises at least one generally horizontal current collector busbar extending along each longitudinal side wall and having a horizontal axis at substantially the vertical level of said metal pad, connectors for connecting said cathode collector bar ends to said collector busbars and a plurality of current taps at points spaced along each of said longitudinal side walls for removing current from said collector busbars, said current taps being connected to said collector busbars in such positions that current flows through said collector busbars in opposite longitudinal directions on opposite longitudinal sides of each of said taps.

The effectiveness of the opposed current flow in the cathode collector bar in producing changes of sign in $B_z$ is significantly enhanced by positioning the anode risers so that the vertical axes thereof substantially coincide (i.e. are substantially aligned in the transverse direction of the cell) with the center line of said current taps.

Another aspect of the invention aims at minimizing the effects of busbar currents on the vertical magnetic field component at the level of the metal pad, as well as saving space between cells, by tapping current emerging from the cell vertically downwardly below the level of the metal pad.

Thus, according to another aspect of the invention, there is provided an aluminum electrolysis cell having opposed longitudinal side walls and opposed end walls, a lining for containing cell contents including a molten metal pad, cathode collector bars extending through the lining, cathode collector bar ends extending from said longitudinal side walls, generally horizontal collector busbars extending along said side walls for collecting current from said collector bar ends and additional busbars for removing current from said collector busbars, wherein said additional busbars include vertically disposed current taps for conveying current from said collector busbars vertically downwardly to a vertical level below said metal pad to limit magnetic influences from said additional busbars on said metal pad.

Yet other aspects of the invention also have the object of minimizing the effects of busbar currents on the vertical magnetic component at the molten pad level, as well as saving inter-cell space (at least in one of these further aspects). This is achieved, in round-end, under-cell crisscross type of busbar configurations, by substantially cancelling the magnetic effects of long busbar runs parallel to the longitudinal cell axes by positioning runs from one cell having current flowing in one direction in close proximity to runs from an adjacent cell having currents of similar size flowing in the opposite direction.

Thus, according to another aspect of the present invention, there is provided an arrangement of busbars and anode risers between adjacent aluminum electrolysis cells in a row of such cells, each cell of the row being generally rectangular with opposed longitudinal side walls and opposed ends and being substantially symmetrical about a central transverse axis, the cells being arranged in said row with the transverse axes thereof substantially in alignment, each cell having upstream and downstream cathode collector bars and at least one anode beam; said arrangement of busbars and anode risers comprising, with respect to the cell halves on one side of the transverse axes:

at least two anode risers for each cell half, the anode risers being connected to said at least one anode beam of each cell half at points spaced along said beam so that each cell half has an anode riser closer to the longitudinal end of the cell half and an anode riser closer to the centre of the cell; and at least two busbars connecting the upstream collector bars of an upstream cell half with the anode risers of an adjacent downstream cell half; a first one of said busbars connecting a group of said upstream collector bars adjacent to the centre of said upstream cell to the anode riser closer to the longitudinal end of the downstream cell and passing around the longitudinal end of said upstream cell half; and a second one of said busbars connecting a group of said collector bars of said upstream cell half adjacent to the longitudinal end of the cell half to the anode riser of the downstream cell half closer to the centre of the downstream cell half and passing beneath the upstream cell half;

said first busbar including a first elongated horizontal run extending transversely of the row between the respective cell half and an adjacent upstream cell half at a vertical level below said collector bars;

said second busbar including a second elongated horizontal run extending transversely of the row between the respective cell half and an adjacent downstream cell half at a vertical level below said collector bars;

said first and second elongated horizontal runs of adjacent cells being positioned such that said elongated runs lie in closely spaced generally parallel relationship to each other and being orientated such that the current flows through a first elongated run in a direction opposite to that in which current flows through an adjacent second elongated run.

According to yet another aspect of the present invention there is provided an arrangement of busbars and anode risers between adjacent aluminum electrolysis cells in a row of such cells, each cell of the row being generally rectangular with opposed longitudinal side walls and opposed ends and being substantially symmetrical about a central transverse axis, the cells being arranged in said row with the transverse axes thereof substantially alignment, each cell having upstream and downstream cathode collector bars and at least one anode beam; said arrangement of busbars and anode risers comprising, with respect to the cell halves on one side of the transverse axes:

at least two anode risers for each cell half, the anode risers being connected to said at least one anode beam of each cell half at points spaced along said beam so that each cell half has an anode riser closer to the longitudinal end of the cell half and an anode riser closer to the centre of the cell; and at least two busbars connecting the upstream collector bars of an upstream cell half with the anode risers of an adjacent downstream cell half; a first one of said busbars connecting a group of said upstream collector bars adjacent to the centre of said upstream cell to the anode riser closer to the longitudinal end of the downstream cell and passing around the longitudinal end of said upstream cell half; and a second one of said busbars connecting a group of said collector bars of said upstream cell half adjacent to the longitudinal end of the cell half to the anode riser of the downstream cell half closer to the centre of the downstream cell half and passing beneath the upstream cell half;

said first busbar including an elongated run extending inwardly between said cell half and said cell half next downstream, and said second busbar including a longitudinal run adjacent to said end group of current collector bars;

said elongated run of a first cell half being positioned in close parallel relationship to said longitudinal run of said second busbar of a cell half next downstream, said elongated run and said longitudinal run being arranged so that current flows in opposite directions in said runs.

DETAILED DESCRIPTION OF THE INVENTION

Figure 1:
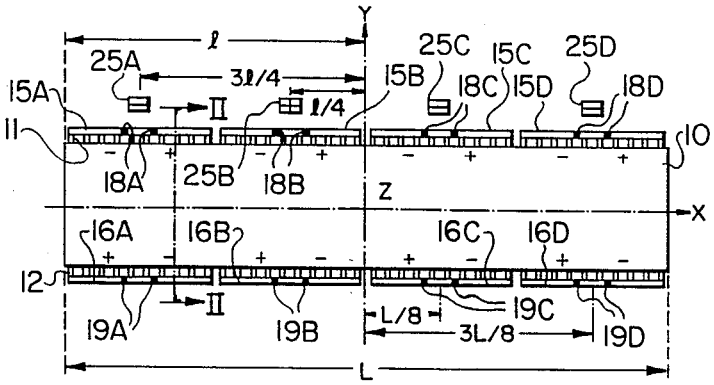
FIG. 1 is a plan view of a cell showing an arrangement of cathode collector bar ends, collector busbars and current taps according to a preferred form of a first aspect of the invention.

In the following disclosure, the vertical component of the magnetic field acting on the cell is referred to as $B_z$ since the axes of the cell are defined as X for the longitudinal cell axis, Y for the transverse cell axis (and the longitudinal row axis), and Z for the vertical cell axis. Moreover, the term "ingoing" is used to describe current travelling from the longitudinal ends of the cell towards the cell centre generally parallel to the X axis (or to busbars carrying such current), and the term "outgoing" is used to describe current travelling in the opposite direction (or busbars carrying such current).

Furthermore, the term "higher level" is used to describe horizontal busbar runs positioned at about the same vertical level as the metal pad and "lower level" is used to describe horizontal busbar runs positioned at vertical levels below the bottom wall of the cell. Higher level and lower level busbar runs are normally connected by generally vertical busbar runs. The bottom end of an anode riser (referred to as an anode riser foot) extends vertically upwardly from the lower level, although a connection can also be made at the higher level.

Whenever possible, like or identical parts are identified by like or identical reference numerals throughout the various figures of drawings. The addition of a prime (e.g. as in 15'), indicates that the element belongs to a downstream cell when a figure illustrates two adjacent cells or parts thereof.

Figure 2:
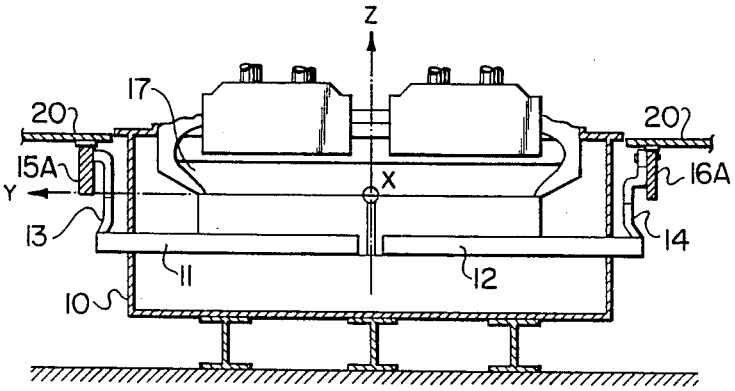
FIG. 2 is a cross-section of the cell shown in FIG. 1 taken on the line II—II of the figure.

A preferred embodiment of the first aspect of the present invention is shown in FIGS. 1 and 2. The drawings show a cell 10 having upstream cathode collector bars 11 and downstream cathode collector bars 12 having ends extending from the respective sides of the cell. The collector bars 11 and 12 are connected, by means of generally vertical cathode collector bar risers 13, 14 (referred to hereinafter as cathode flexibles), to collector busbars 15A, 15B, 15C and 15D on the upstream side of the cell and collector busbars 16A, 16B, 16D and 16D on the downstream side of the cell. The collector busbars 15A–D and 16A–D extend horizontally parallel to the sides of the cell with their longitudinal axes (mid vertical height) positioned approximately at the vertical level of the metal pad 17 (i.e. at the higher level, namely vertically between the upper and lower surfaces of the metal pad 17).

Current is tapped downwardly from each of the collector busbars by current taps 18A–D or 19A–D (see FIG. 1). As shown, each collector busbar has a pair of such taps (i.e. collector busbar 15A has a pair of taps 18A, etc). The tap pairs are centred at the half-cell quarter points (i.e. $\frac{1}{4}$, $3\frac{1}{4}$ where 1 is the length of the half cell). Paired taps are used in preference to single taps because they result in greater convenience, better current distribution and improved space-saving.

The result of placing the collector busbars 15A–D, 16A–D as shown and tapping their current at the points described is to generate within the metal pad 17 a vertical field component whose sign alternates as indicated by the "+" and "−" signs shown in FIG. 1. This is because the direction of the current flowing in any one collector busbar is ingoing on one side of the tap point and outgoing on the opposite side of the tap point.

The effectiveness of this reversal is enhanced by positioning the anode risers 25A, B, C, D (see FIGS. 3, 5 and 6) such that their vertical axes substantially coincide with the centerlines of the current taps 18A, B, C, D.

In the particular embodiment shown in FIGS. 1 and 2, there are four upstream collector bars 18A to 18D and four downstream collector busbars 19A to 19D, and each collector busbar is connected to ten cathode collector bars. Changes could be made to the number of collector busbars and to the number of cathode collector bars connected to each collector busbar because these variables, in themselves, do not necessarily dictate the number of sign reversals in $B_z$ along the cell. The latter is determined by the number of taps and current paths from the cathode collector bars 11, 12 to the taps. There should preferably be more than two taps per cell side in order to produce sufficient sign changes to prevent instabilities of the metal surface from developing. On the other hand, if there are more than four taps per cell side, the $B_z$ peaks intervening between the zero points might then be so small that they would be swamped by stronger vertical fields originating from other conductors. Four taps per cell side seem to be the optimum number for a cell having forty cathode collector bars 11, 12 as shown.

Instead of providing four individual collector busbars 18A–18D and 19A–19D along each side of the cell, there may be fewer, each being provided with multiple taps since current will flow from the collector bars to the closest tap and thus the desired current reversal along the cell sides will still be achieved. Indeed, there need only be one collector busbar running from cell end to cell end along each side of the cell with four taps or pairs of taps spaced along each cell side. Although the use of a single collector busbar along each cell side would have the disadvantages of difficult installation and large thermal expansion/contraction, the installation problem can be overcome by assembling each collector busbar from two halves which are field welded and the thermal expansion/contraction problem can also be overcome by providing a central flexible section.

Figure 3:
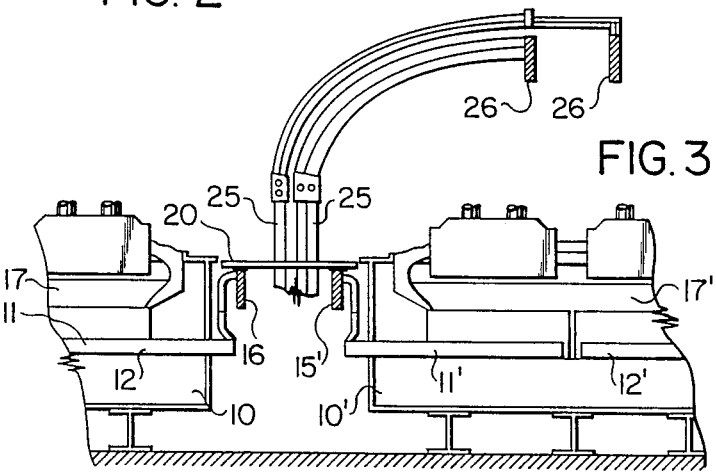
FIG. 3 shows parts of two adjacent cells of the type shown in FIGS. 1 and 2 and illustrates the way anode risers convey current from an upstream cell (left cell) to a downstream cell (right cell)

As will be apparent from FIG. 2 and, more especially, FIG. 3, the provision of one or more horizontal collector busbars 15, 16 along each side of the cell at the higher level has the additional advantage that the collector busbars are ideally positioned to act as supports for an inter-cell working floor 20 (known as a grating). This eliminates the need for costly independent supports for such a working floor.

The sign reversal in $B_z$, achieved in the manner discussed above, should be isolated as much as possible from $B_z$, components originating from other conductors. The further aspects of the present invention discussed below are indented to achieve this object, as well as others.

Figure 4:
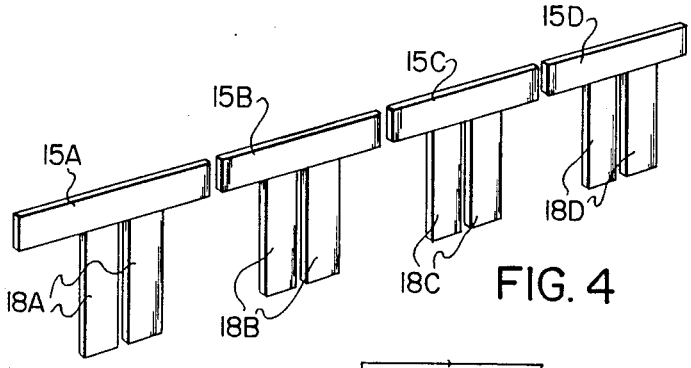
FIG. 4 shows collector busbars and current taps of the type used in FIGS. 1 to 3 and illustrates a preferred form of a further aspect of the invention.

Firstly, as shown in FIG. 4, the paired current taps 18A–18D on the upstream side of the cell convey the current substantially vertically downwardly by virtue of the fact that they are connected to the bottom faces of the collector busbars 15A–15D and are orientated vertically. The upper ends of the taps could, however, be attached to either one of the vertical faces of the collector busbars, if desired, although this arrangement would be less economical of inter-cell space. In any event, by employing vertical taps, the current is conveyed in this way beneath the level of the metal pad and preferably below the bottom of the cell, i.e. to the lower level.

By this arrangement, subsequent cathode busbar runs are positioned at the lower level (except for those cases where it is desirable to have certain runs at the higher level) where their magnetic influences are minimized. It is a particular advantage that long inward and outward busbar runs at the higher level can be avoided in this way because the influence of such runs on $B_z$ is substantial. Another benefit is that less space is necessary for subsequent longitudinal busbar runs positioned at the lower level as opposed to runs situated at the higher level and interfering with the feet of anode risers. Thus, adjacent cells in a row can be brought closer together, leading to decreased potroom length and thus to lower investment costs.

Once the current has reached the lower level on the upstream side of the cell it must be conveyed to the anode risers of the cell next downstream by subsequent busbar runs. There are normally as many anode risers as vertical taps 18A, etc. and the anode risers are usually aligned approximately with those taps, i.e. they are spaced at usually regular intervals between the adjacent cells in the X direction. By aligning the anode risers (particularly their horizontal parts — see FIG. 3) with the taps, the magnetic effects of the anode risers strength the desirable magnetic effects of the collector busbars 15, 16.

Incidentally, the anode risers normally have "positive" and "negative" runs, the positive risers being connected to the cathode busbars issuing from the upstream side of the upstream cell, and the negative riser being connected to cathode busbars issuing from the downstream side of the upstream cell. This is necessary in order to push the equi potential as far back as possible from the upstream cell, so as to decrease the difference in path length from the collector busbars on the two sides of the cell to the cell next downstream.

Use is made in the present invention of a "crisscross" arrangement of busbars whereby current from end upstream collector bar groups is conveyed to the innermost anode riser of the cell next downstream and current from innermost collector bar groups conveyed to the outermost anode risers of the cell next downstream. In this way, current from the central region of the upstream side of the cell is switched over to the lateral regions of the cell next downstream, while current from the lateral regions of the upstream side of the cell is switched over to the central region of the cell next downstream. Use is also made of a round-end, under-cell arrangement of the busbars whereby current from a central group of upstream collector bars is conveyed around the ends of the cell whereas current from an endmost group of collector bars is conveyed under the cell. The combination of the crisscross arrangement with the round-end, under-cell busbar paths has the advantage that there is less discrepancy in length between the paths followed by the upstream busbars, so there need be less discrepancy between the cross-sections of the busbars and these cross-sections can be made smaller for a given voltage drop. The round-end, under-cell arrangement can also be used to optimize cell magnetics by suitably positioning various busbar runs. For example, the under-cell busbar runs can be positioned to reduce the spread of $B_z$ at the cell ends by introducing additional zero points (crossings) in $B_z$. The round end current may require a single busbar run whereas the undercell current may require several parallel runs, each positioned so as to modify $B_z$ locally in the appropriate manner. A substantial part of the current which goes under the cell should advantageously be taken across near the ends of the cell, i.e. beyond the cell's quarter point or three quarter point (depending on which cell half is being considered). Moreover, neutralizing the detrimental effects of the anode risers on $B_z$ at the cell ends requires some of the round-end current to be passed along the cell ends at the upper level.

As well as employing the round-end and under-cell crisscross arrangement, the upstream collector bar runs are also positioned so as to minimize the effects on $B_z$ of longitudinal (inward and outward) runs. This is explained with reference to a preferred embodiment shown in FIGS. 5 and 6.

Figure 5:
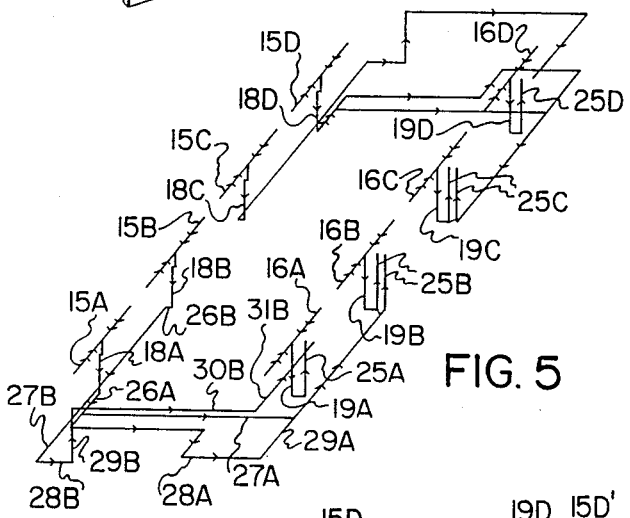
FIG. 5 is a perspective view of a preferred arrangement of cathode busbars of one cell and the feet of anode risers of an adjacent downsteam cell according to another aspect of the invention.
Figure 6:
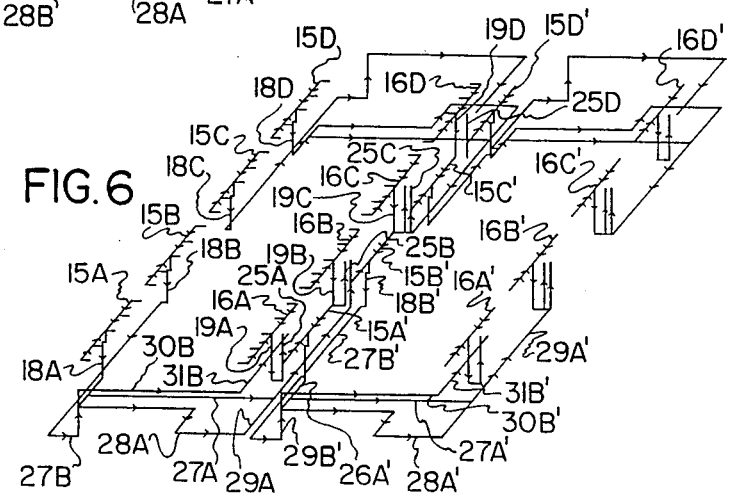
FIG. 6 is a perspective view of busbars and anode risers equivalent to FIG. 5 but also showing the busbars of an adjacent downstream cell.

FIG. 5 is a perspective view of the busbars of a single cell (the cell itself not being shown for simplicity) and the feet of the anode risers for an adjacent downstream cell. FIG. 6 is a perspective view similar to FIG. 5 but additionally showing the busbars of the downstream cell.

As in the case of the embodiment of FIG. 1, the cathode collector bars on the upstream side of the cell are arranged in four groups by virtue of their connection to collector busbars 15A, 15B, 15C and 15D and the current is tapped vertically downwardly from these collector busbars by (in this case) single vertical taps 18A, 18B, 18C and 18D. The feet of four anode risers 25A, 25B, 25C and 25D are provided between the adjacent upstream and downstream cells and the upper ends of these anode risers are connected to the anode beams (not shown) of the cell next downstream at corresponding longitudinal spaced positions along the anode beam. This arrangement means that there are two innermost groups of upstream collector bars (those connected to collector busbars 15B and 15C), two outermost groups of collector bars (those connected to collector busbars 15A and 15D), two innermost anode risers 25B and 25C and two outermost anode risers 25A and 25D.

The connections on opposite sides of the transverse central plane of the cell (the plane of the Y axis) are mirror images of one another and so the connections on one side only (the closer side in the view of the figures) will be described.

Collector busbar 15B (connected to the innermost group of collector bars) is connected to the foot of the outermost anode riser 25A, and the collector busbar 15A (connected to the outermost group of collector bars) is connected to the foot of the innermost anode riser 25B in the desired crisscross arrangement mentioned above.

The current from collector busbar 15B is conveyed to the lower level by vertical tap 18B, transversely (Y direction) preferably to approximately the central longitudinal plane between the cell in question and the cell next upstream (not shown) by short transverse busbar run 26B, outwardly along the inter-cell mid plane by busbar run 27B to a point a short distance beyond the longitudinal end of the cell, transversely for part of the width of the cell by horizontal busbar run 28B, vertically to the upper level by busbar run 29B, transversely at the upper level preferably to approximately the inter-cell mid plane between the cell in question and the cell next downstream by busbar run 30B, and inwardly to the foot of anode riser 25A by busbar run 31B.

Current from collector busbar 15A (connected to the outermost group of collector bars) is conveyed downwardly to the lower level by vertical tap 18A, outwardly by busbar run 26A, transversely beneath the cell by a pair of busbar runs 27A and 28A, which are connected in parallel, spaced slightly apart and take somewhat different paths as shown, and then inwardly by busbar run 29A to the foot of innermost anode riser 25B preferably approximately along the inter-cell mid plane between the cell in question and the cell next downstream.

This arrangement, as well as providing the desired round-end and under-cell configuration of the busbars and the desired crisscross connections of the upstream collector bars to the anode risers, also has a very desirable advantage that becomes apparent when the busbar connections of two adjacent cells are considered, as shown in FIGS. 6. In this figure, busbars and anode risers of the cell downstream from that shown in FIG. 5 are also illustrated. The particular advantage mentioned above is that the inward busbar run 29A of the upstream cell connected the innermost anode riser 25B extends very close and parallel to busbar run 27B' of the downstream cell conveying current at the lower level from the innermost collector busbar 15B', and moreover these busbar runs 29A and 27B' are of virtually the same length. Since these busbar runs carry current in opposite directions (outwardly for busbar run 27B' and inwardly for busbar run 29A) at the same vertical level, the induced magnetic effects caused by these two long horizontal runs are virtually cancelled out so and do not adversely affect $B_z$ at the level of the metal pad. Minimizing the magnetic effects of the inward and outward busbar runs maximizes the desirable magnetic effects of the collector busbars 15, 16.

For the optimum cancelling effect, the two busbar runs should be as close as practically possible, given electrical and mechanical constraints, as similar in length as possible and carry as similar a current as possible (although differences of up to 10% do not have too much of an effect).

The collector bars may of course be arranged in more than two groups per half cell, but cancellation of the magnetic influences of the longitudinal busbar runs becomes more difficult to achieve as their number, which is dictated by the number of collector bar groups, increases beyond two, and current routing generally becomes more of a problem. There could similarly be more than two anode risers per half cell. The number of anode risers is governed by the number of anodes and practical concerns such as the clearance required for the operators to have sufficient access to the anodes. Although the anode risers are normally evenly spaced from each other, this is by no means essential.

As will be apparent from FIGS. 5 and 6, there is no "crisscrossing" of the connections between the downstream collector busbars 16A–D and the anode risers 25A–D, i.e. the downstream collector busbars are connected to the closest anode riser in each case. However, it is necessary that the electrical current in the metal pad "see" the same electrical resistance on either side of the cell, otherwise net transfers of current will occur across the metal pad and this is detrimental to stability. Due to the large difference in path length from the collector busbars on the two sides of the cell to the anode risers, equalizing the upstream and downstream electrical resistances requires drastically reducing the cross-section of the downstream busbars.

Figure 7:
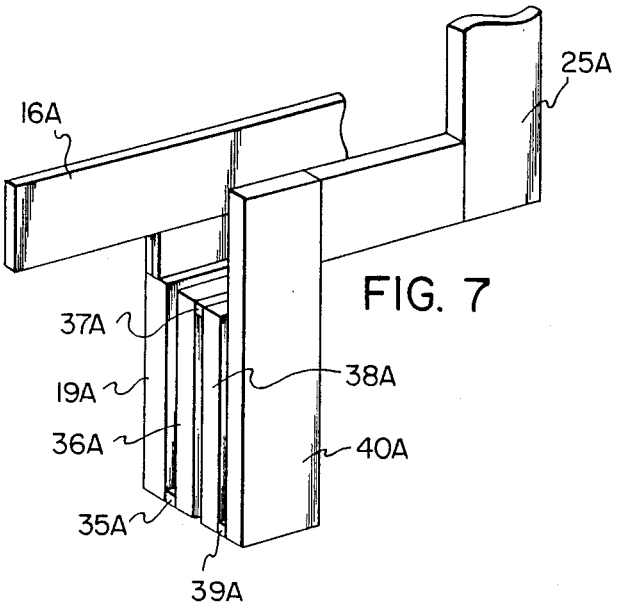
FIG. 7 is a perspective view of a folded busbar configuration which can be used for connections on downstream sides of the cell.

However, there is a maximum current density for busbar material that cannot be exceeded and this places a lower limit on the cross-section of the downstream busbars. As a result, the downstream busbars generally have a significant minimum length which can clutter the inter-cell space. This disadvantage can be overcome by arranging the downstream busbars in a vertically folded configuration, e.g. as shown in FIG. 7. By arranging the busbar runs vertically, the occupied space between the feet of the anode risers is kept to a minimum. Moreover, the vertically folded condition cancels the magnetic field generated by the busbars and thus minimizes the effect on $B_z$ at the level of the metal pad. The figure shows the connection between collector busbar 16A anode riser 15A. This consists of vertical tap 19A, and vertical runs 36A, 38A and 40A interconnected alternately at the top or bottom by connecting pieces 35A, 37A and 39A. This arrangement gives four vertical interconnected runs, but more or less can be provided to achieve the desired result.

Figure 8:
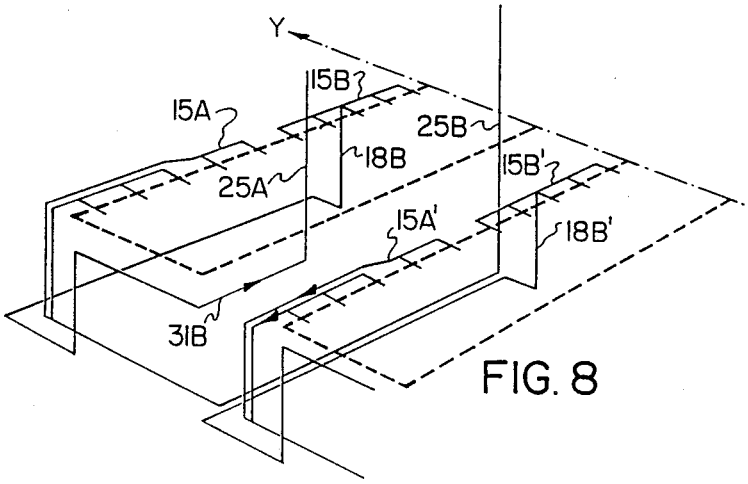
FIG. 8 is a perspective view showing busbar arrangements between two cells according to a further aspect of the invention.

If there is available inter-cell space, an alternative to the vertical tapping of the collector busbars as shown in FIGS. 1 to 6 is possible at both longitudinal ends of the cell. This alternative involves end-tapping the outermost collector busbars as shown in FIG. 8. The Figure shows two adjacent cell halves (indicated in dotted lines) and the connections between the upstream collector busbars 15A, 15B of the cell half and the feet of the anode risers 25A, 25B of the downstream cell. The connections are essentially the same as in FIGS. 5 and 6 except that current is conveyed to the outermost end of the outermost collector busbar 15A before being led vertically downwardly to the lower level.

With this arrangement, the ingoing longitudinal busbar run 31B which leads the round-end current to the foot of the outermost anode riser 25A of the cell next downstream substantially cancels the magnetic influence of the outgoing longitudinal collector busbar run 15A' of the cell next downstream. Such a cancellation may or may not be beneficial depending on the exact geometry of busbar and cell systems. The invention is illustrated further by the following example.

EXAMPLE

Figure 9:
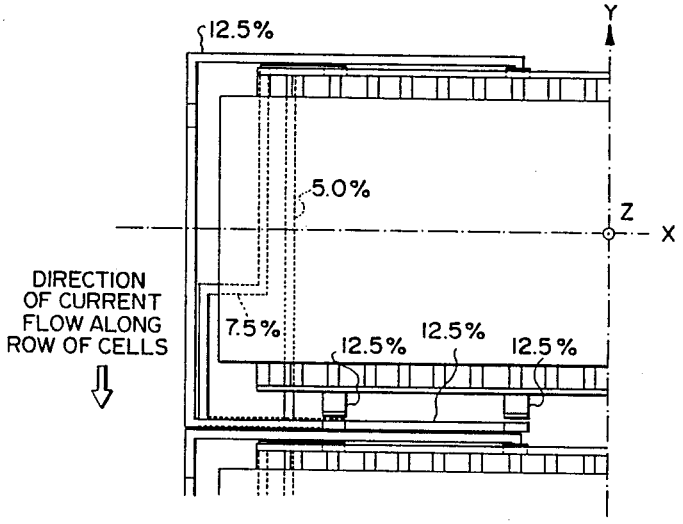
FIG. 9 is a plan view of a cell half and part of an adjacent downstream cell half showing a busbar arrangement used in the example.

Two cells having busbar designs generally as shown in FIG. 9 were constructed and operated. The cells had a distance of 6.5 m between cell centre lines. The total cell current was 310 KA, with 20 collector bars (not all of which are shown in FIG. 9) and 8 prebaked anodes (not shown) per cell quarter for a total of 80 collector bars and 32 anodes. There were four equally loaded, sloped anode riser groups along the full length of the cell, each group consisting of one "positive" riser (25A, 25B) connected to cathode busbars issuing from the upstream side of the upstream cell, and one "negative" riser connected to cathode busbars issuing from the downstream side of the upstream cell (25AA, 25BB). Each positive anode riser and each negative anode riser carried the current from ten collector bars of the upstream cell.

All horizontal busbar runs were either at cell cavity level or at the level of the under-cell busbars.

The percentages of the live current flowing through the busbars are shown in FIG. 9.

Figure 10:
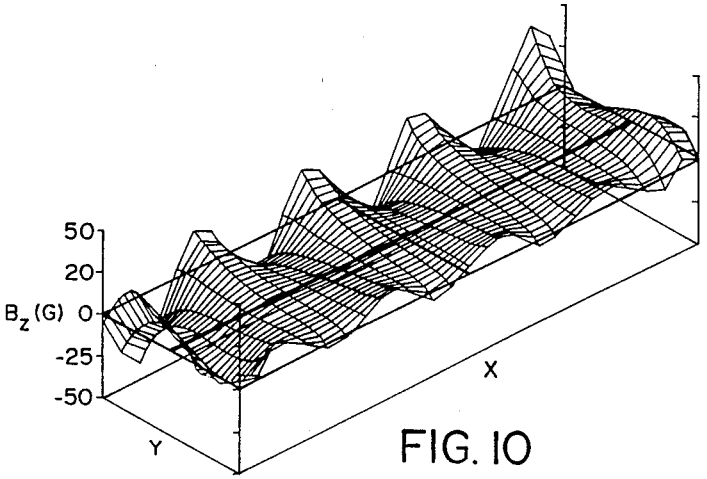
FIG. 10 is a graph indicating a perspective view of the vertical component ($B_z$) of the magnetic field at the metal pad of a cell having the busbar configuration of FIG. 9.

FIG. 10 shows the distribution of $B_z$ within the cell at the level of the metal pad. The sign reversal in the longitudinal direction of the cell can clearly be seen and, even at the upstream corners of the cell, the intensity of $B_z$ does not exceed 40G at any point within the "anode shadow" (i.e. directly beneath the anode). The resulting cell is devoid of substantial metal pad instabilities.

What we claim is:

1. In an aluminum electrolysis cell having opposed longitudinal side walls and opposed end walls, a lining for containing cell contents including a molten metal pad, cathode collector bars extending through the lining, and cathode collector bar ends extending from each of said longitudinal side walls, the improvement which comprises at least one generally horizontal current collector busbar extending along each longitudinal side wall and having a horizontal axis at substantially the vertical level of said metal pad, connectors for connecting said cathode collector bar ends to said collector busbars and a plurality of current taps at points spaced along each of said longitudinal side walls for removing current from said collector busbars, said current taps being connected to said collector busbars in such positions that current flows through said collector busbars in opposite longitudinal directions on opposite longitudinal sides of each of said taps.

2. A cell according to claim 1 having at least three current taps per longitudinal cell side.

3. A cell according to claim 1 having four current taps per longitudinal cell side.

4. A cell according to claim 1, wherein said current taps lead current vertically downwardly from said collector busbars.

5. A cell according to claim 1, having a single collector busbar extending along each longitudinal side of said cell.

6. A cell according to claim 1, having a plurality of collector busbars extending in substantial horizontal alignment along each longitudinal side of said cell.

7. A cell according to claim 1, having four collector busbars extending along each longitudinal side of said cell, each said collector busbar being connected to a separate current tap at approximately the central point of the collector busbar.

8. A cell according to claim 1, wherein said connectors for connecting each of said collector bar ends to said collector busbars extend generally vertically.

9. A cell according to claim 1, having a plurality of anode risers equal in number to said current taps and positioned at intervals in the longitudinal direction of the cell, said anode risers being positioned such that their vertical axes are generally in alignment in the transverse direction of the cell with central points of said current taps.

10. A pair of adjacent cells according to claim 1, having an element extending between said cells having opposite transverse ends supported by current collector busbars on said adjacent cells to form a working floor.

11. An aluminum electrolysis cell having opposed longitudinal side walls and opposed end walls, a lining for containing cell contents including a molten metal pad, cathode collector bars extending through the lining, cathode collector bar ends extending from said longitudinal side walls, generally horizontal collector busbars extending along said side walls for collecting current from said collector bar ends and additional busbars for removing current from said collector busbars, wherein said additional busbars include vertically disposed current taps for conveying current from said collector busbars vertically downwardly to a vertical level below said metal pad to limit magnetic influences from said additional busbars on said metal pad.

12. A cell according to claim 11 wherein longitudinal axes of said collector busbars are positioned at substantially the same height as said metal pad.

13. A cell according to claim 11 wherein a plurality of vertical current taps are provided for each longitudinal side of said cell.

14. A cell according to claim 11 wherein said additional busbars connect said cell to anode risers of an adjacent cell.

15. An arrangement of busbars and anode risers between adjacent aluminum electrolysis cells in a row of such cells, each cell of the row being generally rectangular with opposed longitudinal side walls and opposed ends and being substantially symmetrical about a central transverse axis, the cells being arranged in said row with the transverse axes thereof substantially in alignment, each cell having upstream and downstream cathode collector bars and at least one anode beam; said arrangement of busbars and anode risers comprising, with respect to the cell halves on one side of the transverse axes:

at least two anode risers for each cell half, the anode risers being connected to said at least one anode beam of each cell half at points spaced along said beam so that each cell half has an anode riser closer to the longitudinal end of the cell half and an anode riser closer to the centre of the cell; and at least two busbars connecting the upstream collector bars of an upstream cell half with the anode risers of an adjacent downstream cell half; a first one of said busbars connecting a group of said upstream collector bars adjacent to the centre of said upstream cell to the anode riser closer to the longitudinal end of the downstream cell and passing around the longitudinal end of said upstream cell half; and a second one of said busbars connecting a group of said collector bars of said upstream cell half adjacent to the longitudinal end of the cell half to the anode riser of the downstream cell half closer to the centre of the downstream cell half and passing beneath the upstream cell half;

said first busbar including a first elongated horizontal run extending transversely of the row between the respective cell half and an adjacent upstream cell half at a vertical level below said collector bars;

said second busbar including a second elongated horizontal run extending transversely of the row between the respective cell half and an adjacent downstream cell half at a vertical level below said collector bars;

said first and second elongated horizontal runs of adjacent cells being positioned such that said elongated runs lie in closely spaced generally parallel relationship to each other and being orientated such that the current flows through a first elongated run in a direction opposite to that in which current flows through an adjacent second elongated run.

16. An arrangement according to claim 15 wherein said first and second elongated horizontal runs are positioned adjacent to the mid vertical plane between adjacent cells.

17. An arrangement according to claim 15 having two anode risers and two busbars per cell half.

18. An arrangement according to claim 15, wherein adjacent first and second elongated runs are of substantially the same length.

19. An arrangement according to claim 15, wherein adjacent first and second runs carry currents that are substantially equal.

20. An arrangement according to claim 15, wherein adjacent first and second runs are positioned so close to each other that the induced vertical magnetic fields from the runs substantially cancel each other.

21. An arrangement according to claim 15, wherein said first busbar includes a round end run which extends partly at a vertical level below said metal pad and partly at a level substantially the same as said metal pad with a generally vertical connection therebetween.

22. An arrangement according to claim 15, wherein said second busbar extends under the cell half at a point in the cell half adjacent the longitudinal end thereof.

23. An arrangement according to claim 15, wherein said second busbar divides into two electrically parallel runs which are reconnected prior to the connection of the second busbar to an anode riser, the routes of said parallel runs being such that undesired vertical magnetic effects on said cell are minimized.

24. An arrangement according to claim 15, wherein said at least two busbars include at least two current collector busbars extending along each longitudinal side wall, and having a horizontal axis at substantially the vertical level of said metal pad and a plurality of current taps at points spaced along each of said longitudinal side walls for removing current from said collector busbars, said current taps being connected to said collector busbars in such positions that current flows through said collector busbars in opposite longitudinal directions on opposite longitudinal sides of each of said taps.

25. An arrangement according to claim 24 wherein said current taps are generally vertically disposed so that current conveyed by said taps flows vertically downwardly to a vertical level below said metal pad to limit magnetic influences of said current on said metal pad.

26. An arrangement according to claim 15, wherein groups of downstream collector bars are connected to adjacent anode risers by means of vertically folded busbars

27. An arrangement of busbars and anode risers between adjacent aluminum electrolysis cells in a row of such cells each cell of the row being generally rectangular with opposed longitudinal side walls and opposed ends and being substantially symmetrical about a central transverse axis, the cells being arranged in said row with the transverse axes thereof substantially in alignment, each cell having upstream and downstream cathode collector bars and at least one anode beam; said arrangement of busbars and anode risers comprising, with respect to the cell halves on one side of the transverse axis:

at least two anode risers for each cell half, the anode risers being connected to said at least one anode beam of each cell half at points spaced along said beam so that each cell half has an anode riser closer to the longitudinal end of the cell half and an anode riser closer to the centre of the cell; and at least two busbars connecting the upstream collector bars of an upstream cell half with the anode risers of an adjacent downstream cell half; a first one of said busbars connecting a group of said upstream collector bars adjacent to the centre of said upstream cell to the anode riser closer to the longitudinal end of the downstream cell and passing around the longitudinal end of said upstream cell half; and a second one of said busbars connecting a group of said collector bars of said upstream cell half adjacent to the longitudinal end of the cell half to the anode riser of the downstream cell half closer to the centre of the downstream cell half and passing beneath the upstream cell half;

said first busbar including an elongated run extending inwardly between said cell half and said cell half next downstream, and said second busbar including a longitudinal run adjacent to said end group of current collector bars;

said elongated run of a first cell half being positioned in close parallel relationship to said longitudinal run of said second busbar of a cell half next downstream, said elongated run and said longitudinal run being arranged so that current flows in opposite directions in said runs.

* * * * *